US006979213B1

(12) United States Patent
Mauney et al.

(10) Patent No.: US 6,979,213 B1
(45) Date of Patent: Dec. 27, 2005

(54) ELECTRICAL JUNCTION BOX WITH SLIDING LOCK LEVER

(75) Inventors: Joseph Mauney, South Lyon, MI (US); Nathan Like, St. Clair Shores, MI (US); J. Patrick Dunbar, Canton, MI (US)

(73) Assignee: SEWS-DTC, Inc., Dearborn, MI (US)

( * ) Notice: Subject to any disclaimer, the term of this patent is extended or adjusted under 35 U.S.C. 154(b) by 0 days.

(21) Appl. No.: 10/969,411

(22) Filed: Oct. 20, 2004

(51) Int. Cl.[7] ..... H01R 13/62
(52) U.S. Cl. ..... 439/157; 439/310; 439/347
(58) Field of Search ..... 439/76.1, 76.2, 439/157, 310, 347, 949

(56) References Cited

U.S. PATENT DOCUMENTS 5,967,808 A * 10/1999 Kubota ..... 439/157
5,997,322 A * 12/1999 Kashiyama et al. ..... 439/157
6,012,934 A * 1/2000 Aoki et al. ..... 439/157
6,019,619 A * 2/2000 Aoki et al. ..... 439/157
6,739,889 B1 * 5/2004 Daggett et al. ..... 439/157

* cited by examiner

*Primary Examiner*—Khiem Nguyen
(74) *Attorney, Agent, or Firm*—Oliff & Berridge, PLC

(57) ABSTRACT

An electrical junction box is provided including a mounting cover, a connector, and a slide-arm. The connector is disposed within the mounting cover and includes a boss. The slide-arm is slidably supported by the mounting cover and includes a slanted driving surface. The slide-arm is operable to displace the connector by slidably engaging the boss with the slanted driving surface.

16 Claims, 6 Drawing Sheets

ELECTRICAL JUNCTION BOX WITH SLIDING LOCK LEVER

FIELD OF THE INVENTION

The present invention relates to an automotive electrical junction box and, more particularly, to an apparatus and method for assembling an electrical connector and bussed electrical center of an automotive electrical junction box.

BACKGROUND OF THE INVENTION

Typical automotive electrical junction boxes include a mounting cover, at least one electrical connector, and a bussed electrical center. The mounting cover is typically mounted to a vehicle body. The electrical center is disposed within the mounting cover and includes a plurality of sockets on its upper face. The bussed electrical center acts as a lid for the mounting cover. The bussed electrical center includes a plurality of terminals or pins extending from a lower surface thereof. The plurality of pins are adapted to engage the plurality of sockets in the electrical connector.

During assembly of a typical electrical junction box, the electrical connector is first placed within the mounting cover. The bussed electrical center is then attached to a rim portion of the mounting cover. A threaded fastener is positioned through an aperture in the bussed electrical center to engage a threaded bore in the electrical connector. Turning the threaded fastener into the electrical connector lifts it into engagement with the pins on the bussed electrical center. While this assembly has provided adequate results, it tends to be time consuming. Additionally, turning the fastener can require a substantial amount of human force and/or participation.

SUMMARY OF THE INVENTION

An electrical junction box is provided including a mounting cover, a connector, and a slide-arm. The connector is disposed within the mounting cover and includes a boss. The slide-arm is slidably supported by the mounting cover and includes a slanted driving surface. The slide-arm is operable to displace the connector by slidably engaging the boss with the slanted driving surface.

Another aspect of the present invention provides an electrical junction box including a mounting cover, an electrical center, a connector, and a slide-arm. The electrical center is supported on the mounting cover. The connector is disposed between the mounting cover and the electrical center. The slide-arm is slidably supported by the mounting cover for sliding engagement with the connector. The slide-arm is operable to displace the connector away from the slide-arm and into engagement with at least a portion of the electrical center.

Yet another aspect of the present invention provides a method of assembling an electrical junction box. First, a mounting cover is provided. A slide-arm is then positioned in a first position on the mounting cover. A connector is positioned within the mounting cover and in sliding engagement with a portion of the slide-arm. Lastly, the connector is driven away from the slide-arm by linearly translating the slide-arm relative to the mounting cover toward a second position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
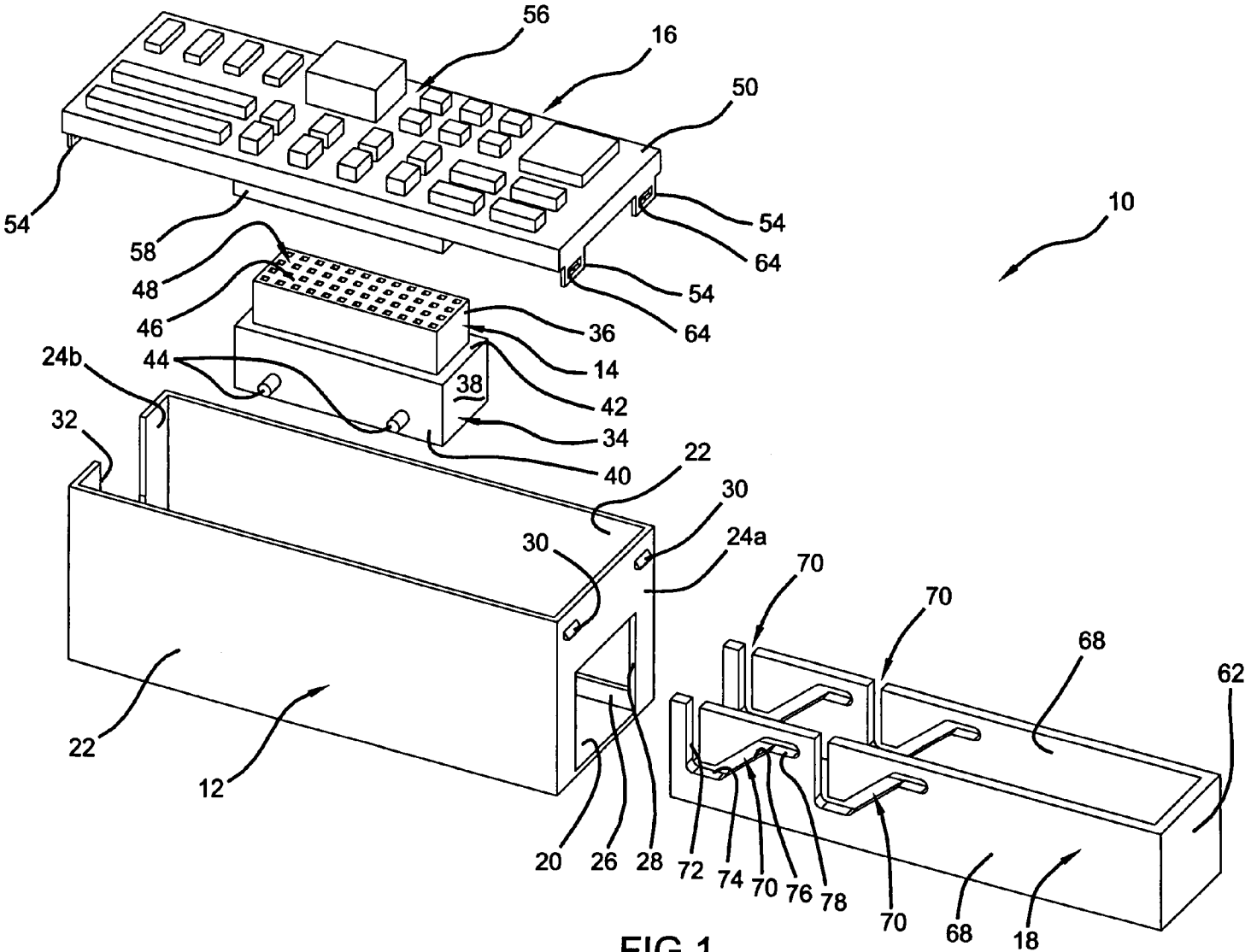
FIG. 1 is an exploded perspective view of an electrical junction box in accordance with the principles of the present invention.

The following description of the preferred embodiment is merely exemplary in nature and is in no way intended to limit the invention, its application, or uses.

FIGS. 1–6 depict an electrical junction box 10 including a mounting cover 12, a connector 14, a bussed electrical center (BEC) 16, and a slide-arm 18. The mounting cover 12 is adapted to contain the connector 14 and support the BEC 16 thereon. The slide-arm 18 is operable to displace the connector 14 into engagement with the BEC 16.

The mounting cover 12 includes a bottom wall 20, a pair of longitudinal sidewalls 22, a first end sidewall 24*a*, and a second end sidewall 24*b*. The bottom wall 20 includes a pair of guide rails 26. The first end sidewall 24*a* includes a slide-arm aperture 28 and a pair of lock ledges 30. The second end sidewall 24*b* includes a wire aperture 32 and a pair of lock ledges 30. In an exemplary embodiment, the mounting cover 12 is constructed of a polymer such as nylon.

The connector 14 includes a dress cover 34 integrally formed with a connector body 36. The dress cover 34 is a generally hollow box including a pair of end walls 38, a pair of sidewalls 40, and a top surface 42. The sidewalls 40 each include a pair of cylindrical bosses 44. The connector body 36 is a generally box-shaped member disposed on the top surface 42 of the dress cover 34. The connector body 36 includes a top surface 46 having a plurality of sockets 48. Each of the plurality of sockets 48 include a metal contact (not shown) for completing an electrical circuit, which will be described in more detail below. It is important to note that the dress cover 34 includes an open bottom and an aperture 41 in its top surface 42. The open bottom of the dress cover 34 enables a plurality of wires (not shown) to be stored therein. Additionally, the plurality of wires extend through the aperture 41 in the top surface 42 of the dress cover 34 and attach to the metal contacts disposed within the plurality of sockets 48 of the connector body 36. The wires are attached to the contacts via solder or other electrical connecting means.

The BEC 16 is a generally planar member including a top surface 50, a bottom surface 52, and a plurality of lock tabs 54. The top surface 50 includes a plurality of sockets (not shown) receiving a plurality of fuses, relays, and other electrical components, herein identified by reference number 56. The bottom 52 of the BEC 16 includes a terminal housing 58 and a plurality of terminals 60. In the embodiment illustrated, the plurality of terminals 60 include a plurality of metal pins. It should be appreciated that the plurality of terminals 60 and plurality of sockets receiving the electrical components 56 are electrically connected via wires or other electrical conductive means molded within the BEC 16. The plurality of lock tabs 54 on the BEC 16 are formed integral with the planar member of the BEC 16 and include square apertures 64. The square apertures 64 receive the lock ledges 30 on the end sidewalls 24*a*, 24*b* securing the BEC 16 to the mounting cover 12.

The slide-arm 18 is a generally elongated member having a U-shaped cross-section including a bottom wall 66, a pair of sidewalls 68, and a rear wall 62. Each of the pair of sidewalls 68 include a pair of cam slots 70. Each cam slot 70 includes an upright portion 72, a first landing portion 74, a slanted portion 76, and a second landing portion 78. The rear wall 62 extends generally perpendicularly between the pair of sidewalls 68 and bottom wall 66. The slide-arm 18 is received through the slide-arm aperture 28 of the first end sidewall 24*a* of the mounting cover 12. The bottom wall 66 of the slide-arm 18, therefore, slidably engages the bottom wall 20 of the mounting cover 12.

Figure 2:
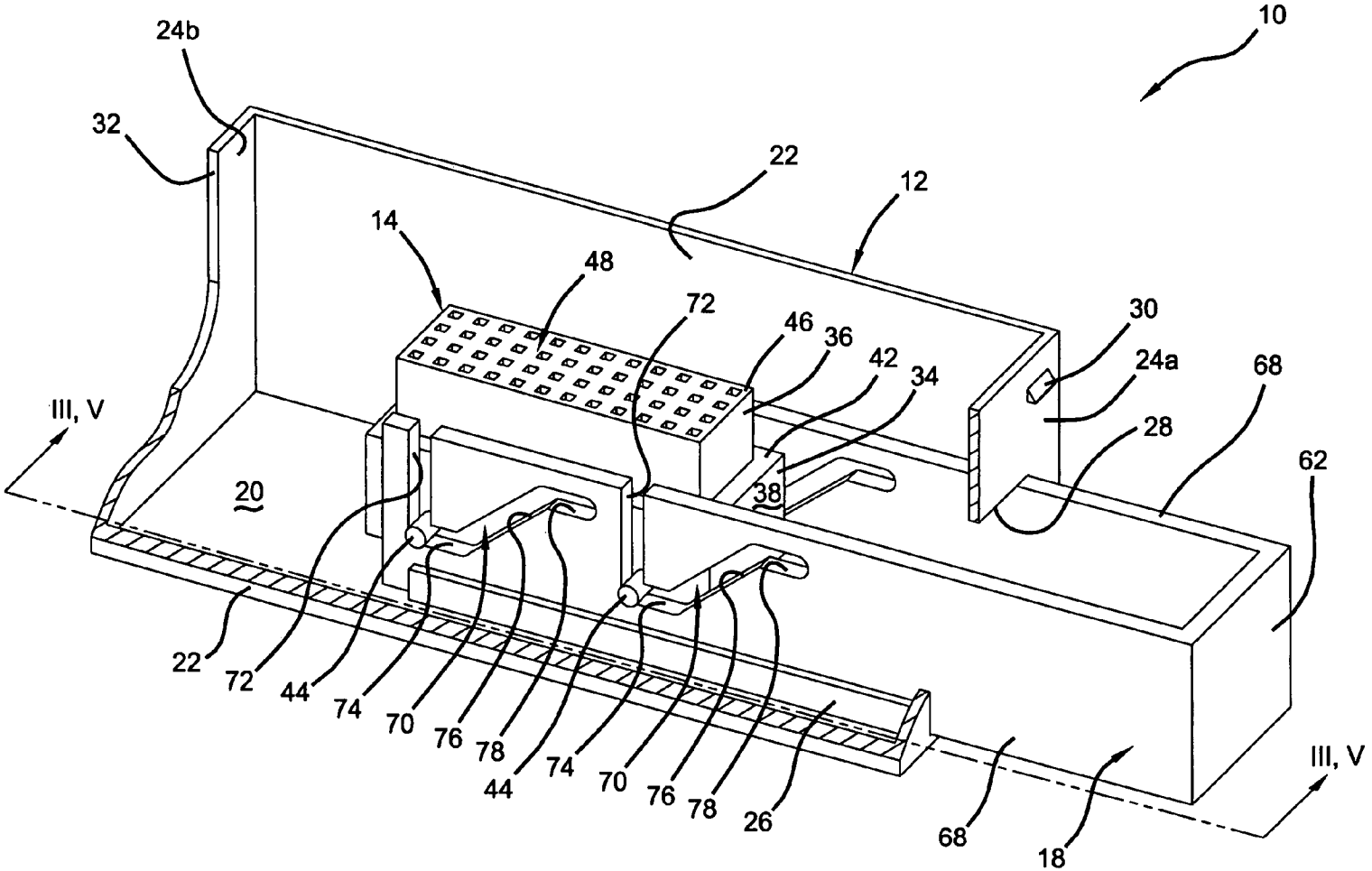
FIG. 2 is a partial cut-away perspective view of the electrical junction box of FIG. 1 in a pre-staged position.

FIG. 2 depicts the electrical junction box 10 in a pre-staged assembled position. The slide-arm 18 is received through the slide-arm aperture 28 of the mounting cover 12 to a first position between the guide rails 26. The connector 14 is disposed within the mounting cover 12 in engagement with the slide-arm 18. The cylindrical bosses 44 extending from the dress cover 34 engage the first landing portions 74 of the cam slots 70 in the pair of sidewalls 68 of the slide arm 18.

Figure 3:
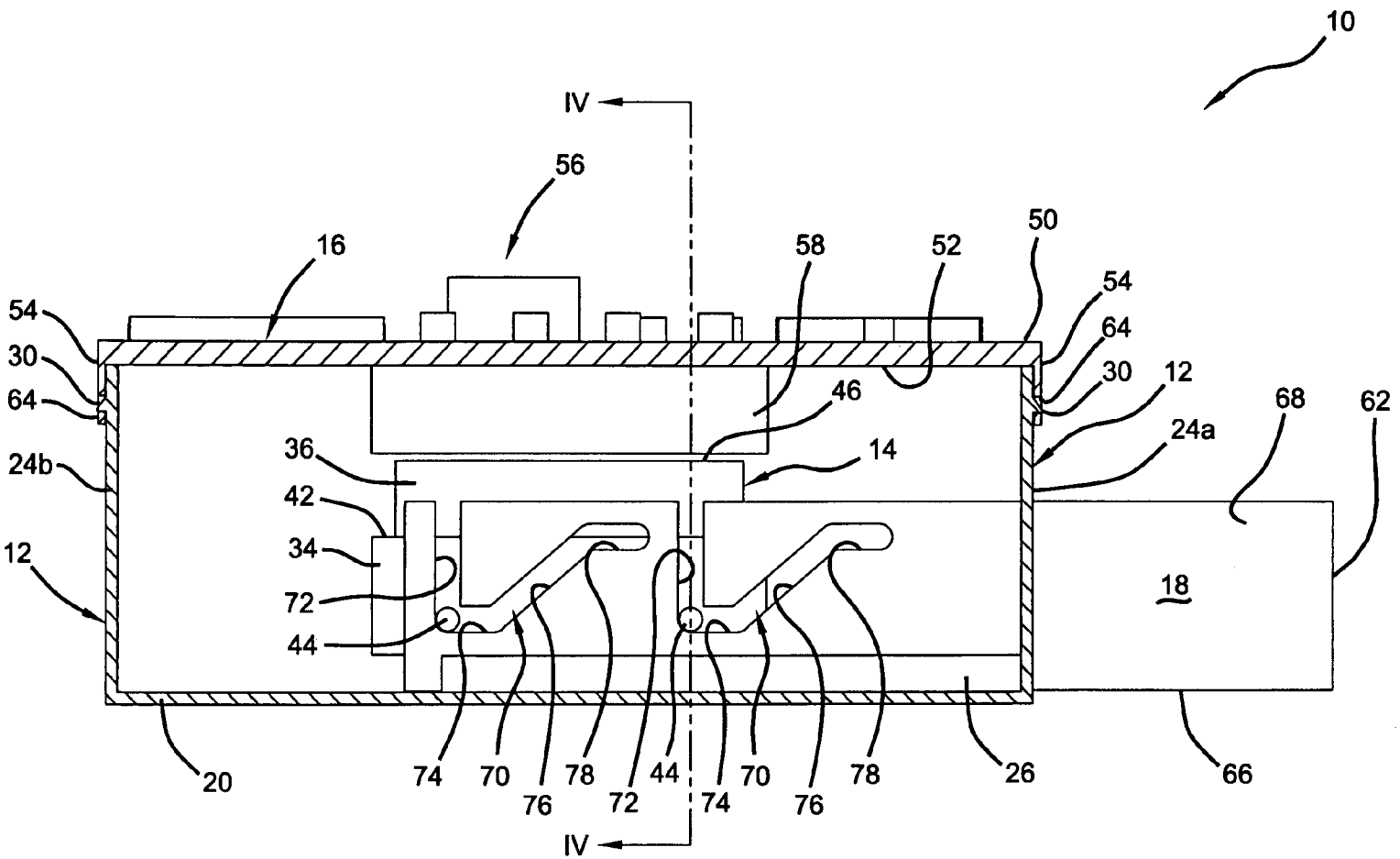
FIG. 3 is a cross-sectional side view of the electrical junction box taken through line III—III of FIG. 2 and including a bussed electrical center.
Figure 4:
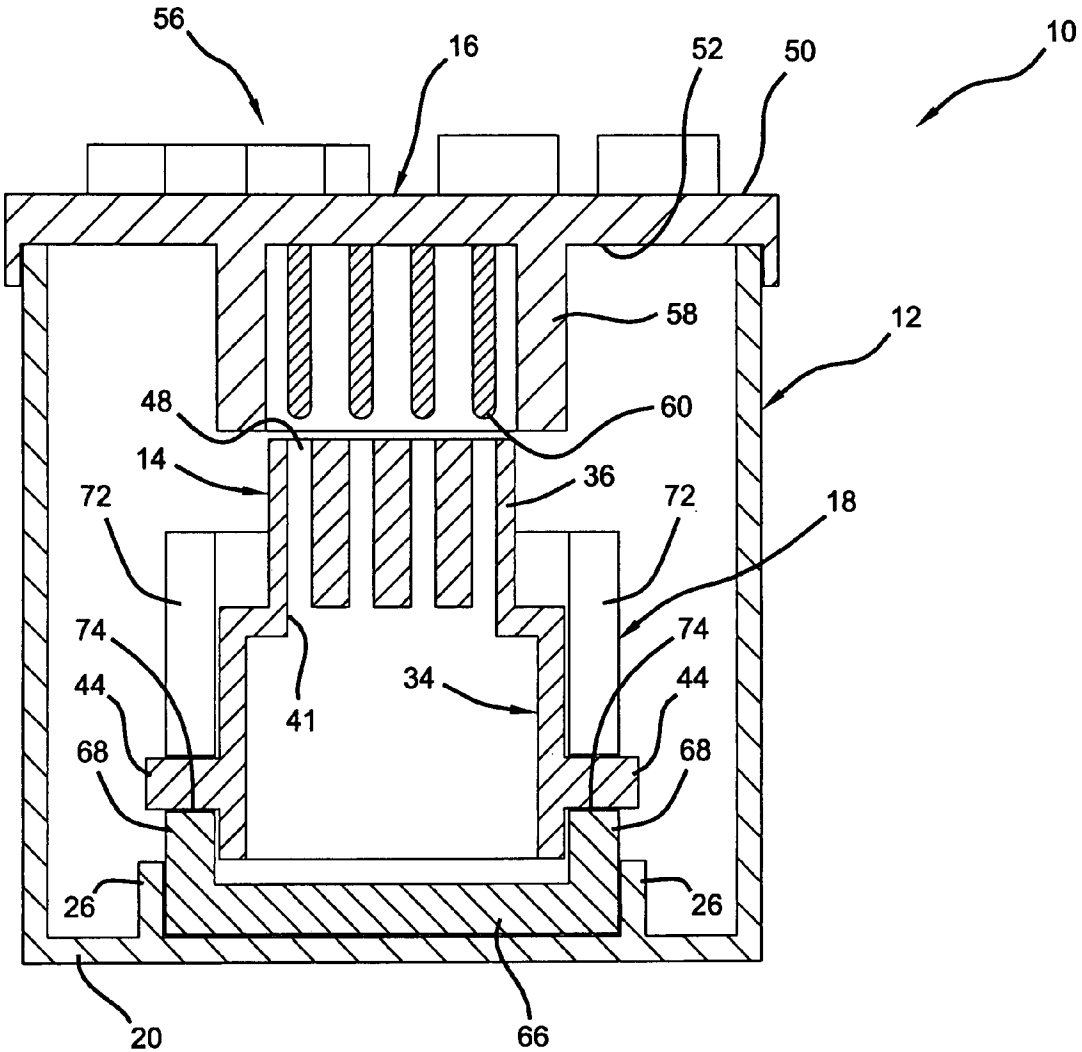
FIG. 4 is a cross-sectional side view of the electrical junction box taken through line IV—IV of FIG. 3.

FIGS. 3 and 4 depict the electrical junction box 10 in the pre-staged position including the BEC 16 attached to the mounting cover 12. The bottom surface 52 of the BEC 16 engages a rim of the mounting cover 12. The apertures 64 of the plurality of lock tabs 54 on the BEC 16 receive the lock ledges 30 formed on the first and second end sidewalls 24*a*, 24*b* of the mounting cover 12. The plurality of terminals 60 extending from the bottom surface 52 of the BEC 16 are substantially axially aligned with the plurality of sockets 48 in the connector body 36 of the connector 14.

Figure 5:
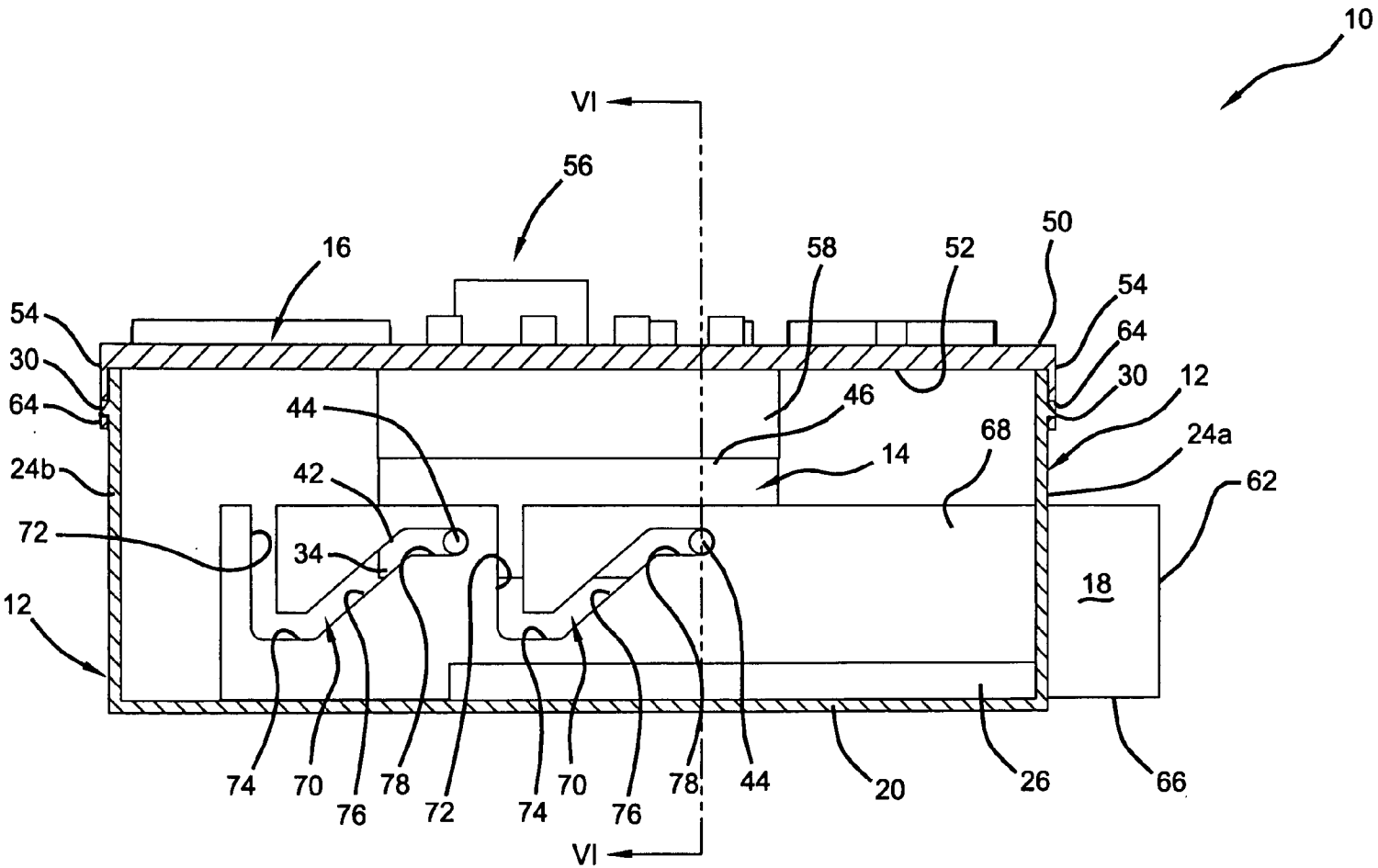
FIG. 5 is a cross-sectional side view of the electrical junction box taken through line V—V of FIG. 2 in an operational position and including a bussed electrical center.
Figure 6:
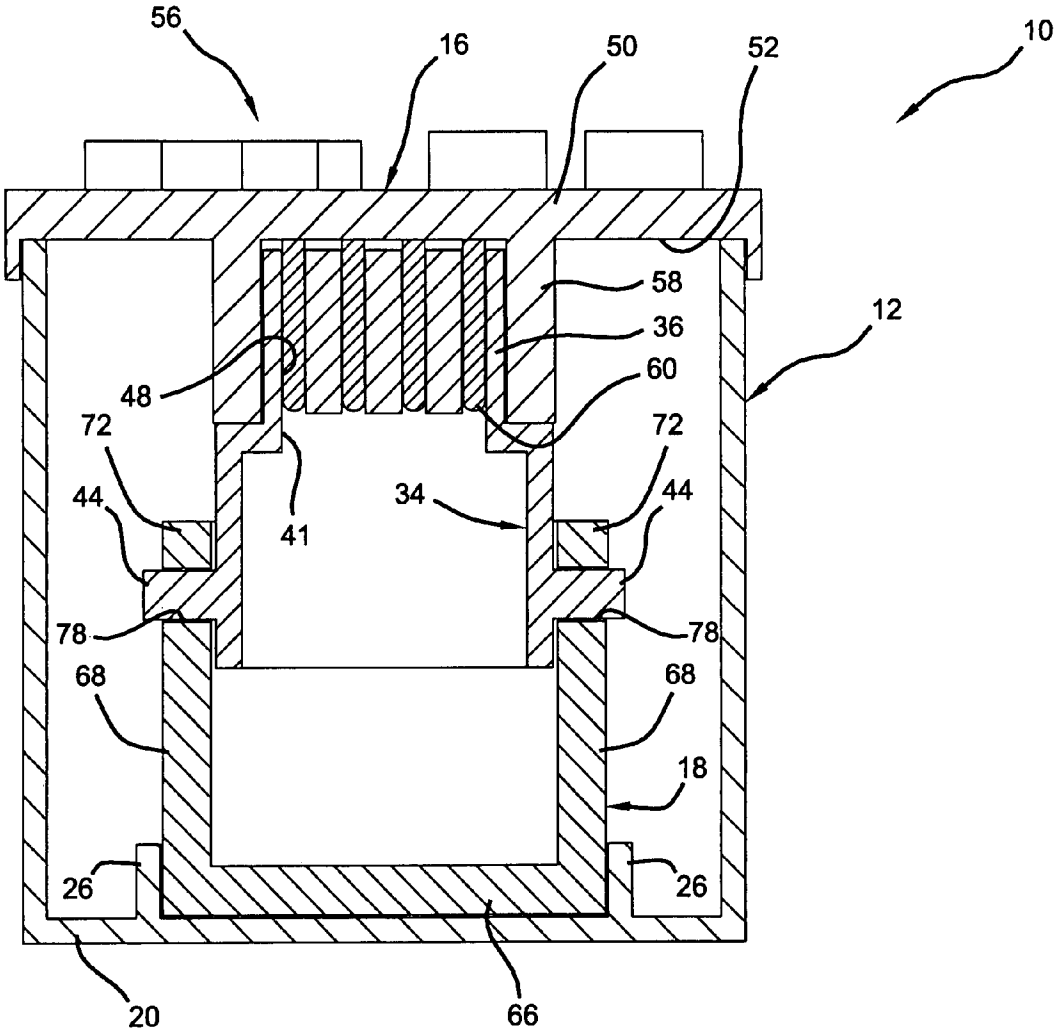
FIG. 6 is a cross-sectional side view of the electrical junction box taken through line VI—VI of FIG. 5.

FIGS. 5 and 6 depict the electrical junction box 10 in an operational position. The slide-arm 18 has been actuated and is disposed within the mounting cover 12 at a second position between the guide rails 26. The cylindrical bosses 44 extending from the dress cover 34 of the connector 14 engage the second landing portions 78 of the cam slots 70 in the sidewalls 68 of the slide-arm 18. As illustrated in FIG. 6, the plurality of terminals 60 are received within the plurality of sockets 48 in the connector body 36 of the connector 14.

During assembly, the mounting cover 12 is mounted to a portion of a vehicle. This may be accomplished with an adhesive, a fastener, or other appropriate means. The slide-arm 18 is then inserted through the slide-arm aperture 28 of the first end sidewall 24*a* to the first position, as illustrated in FIGS. 2, 3 and 4. The connector 14 is then positioned within the mounting cover 12. This includes aligning the cylindrical bosses 44 with the upright portions 72 of the cam slots 70 in the slide-arm 18. To complete the pre-staged position, the connector 14 is allowed to drop into the upright slots 72 to engage the first landing areas 74, as is also illustrated in FIGS. 2, 3 and 4.

The BEC 16 is then positioned on top of the mounting cover 12. The plurality of lock tabs 54 are depressed such that the lock ledges 30 are received through the apertures 64. Finally, an axial load is applied to the rear wall 62 of the slide-arm 18. This displaces the slide-arm 18 into the second position illustrated in FIGS. 5 and 6. Consequently, the slanted portions 76 of the cam slots 70 slidably engage the cylindrical bosses 44 on the connector 14 and drive the connector 14 toward the BEC 16. The terminals 60 disposed on the BEC 16 enter the sockets 48 on the connector 14. Once the slide arm 18 reaches the second position, the cylindrical bosses 44 engage the second landing areas 78 of the cam slots 70. Additionally, the connector body 36 fully receives the plurality of terminals 60 to complete the assembly.

It should be appreciated that the electrical junction box 10 of the present invention provides for a simple, low energy assembly process. Furthermore, it should be appreciated that while the electrical junction box 10 of the present invention has been disclosed as including a single connector 14 and slide-arm 18, an electrical junction box 10 including a plurality of connectors 14 and a plurality of slide-arms 18 is intended to be within the scope of the present invention. For example, in an alternative embodiment, the electrical junction box 10 may include a plurality of slide-arms 18, each independently actuable to displace one of a plurality of connectors 14 into engagement with the BEC 16. Lastly, while it has been disclosed that each of the sidewalls 68 of the slide-arm 18 includes a pair of cam slots 70, an alternative embodiment may include more or less cam slots 70 in the pair of sidewalls 68.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An electrical junction box, comprising:

a mounting cover including a single slide-arm aperture and a bottom wall;

at least one guide rail protruding from the bottom wall of the mounting cover;

a connector disposed within said mounting cover and including a boss; and a slide-arm slidably supported by said mounting cover, wherein said slide-arm includes:

a pair of sidewalls;

a bottom wall joining the sidewalls; and a slanted driving surface, said slide-arm operable to displace said connector by slidably engaging said boss with said slanted driving surface, said slide-arm passing through the mounting cover only at the single slide-arm aperture and engaging the at least one guide rail.

2. The junction box of claim 1 wherein said slide-arm includes a sidewall having a slanted slot defining said slanted driving surface.

3. The junction box of claim 2 further comprising a generally upright slot in communication with said slanted slot and an external edge of said sidewall.

4. The junction box of claim 3 wherein said slide-arm is slidable to drive said boss between a first position located between said upright and slanted slots and a second position located opposite said slanted slot from said first position.

5. The junction box of claim 4 further comprising an electrical center engaging said connector when said connector is in said second position.

6. An electrical junction box, comprising:

a mounting cover including a single slide-arm aperture and a bottom wall;

at least one guide rail protruding from the bottom wall of the mounting cover;

an electrical center supported on said mounting cover;

a connector disposed between said mounting cover and said electrical center; and a slide-arm slidably supported by said mounting cover for sliding engagement with said connector, wherein said slide-arm includes:

a pair of sidewalls; and a bottom wall joining the sidewalls, said slide-arm operable to displace said connector away from said slide-arm and into engagement with at least a portion of said electrical center, said slide-arm passing through the mounting cover only at the single slide-arm aperture and engaging the at least one guide rail.

7. The junction box of claim 6 wherein said slide-arm includes a slanted driving surface slidably engaging a boss on said connector.

8. The junction box of claim 7 wherein said slide-arm includes a sidewall having a slanted slot defining said slanted driving surface.

9. The junction box of claim 8 wherein said sidewall further includes a generally upright slot in communication with said slanted slot and an external edge of said sidewall.

10. The junction box of claim 9 wherein said boss is disposed opposite said slanted slot from said upright slot when said connector is in engagement with said electrical center.

11. A method of assembling an electrical junction box, comprising:

obtaining a mounting cover including a single slide-arm aperture and a bottom wall, at least one guide rail, protruding from the bottom wall of the mounting cover and;

positioning a slide-arm in a first position on said mounting cover, said slide-arm passing through the mounting cover only at the single slide-arm aperture and engaging the at least one guide rail wherein said slide-arm includes:

a pair of sidewalls; and a bottom wall joining the sidewalls;

positioning a connector within said mounting cover and in sliding engagement with a portion of said slide-arm; and driving said connector away from said slide-arm by linearly translating said slide-arm relative to said mounting cover toward a second position.

12. The method of claim 11 wherein positioning said connector includes positioning a boss formed on said connector into an upright slot formed in said slide-arm.

13. The method of claim 11 wherein driving said connector away from said slide-arm includes driving a slanted surface formed on said slide-arm into sliding engagement with a boss formed on said connector.

14. The method of claim 11 wherein driving said connector away from said slide-arm includes applying an axial load to an end of said slide-arm that is located outside of said mounting cover.

15. The method of claim 11 further comprising securing an electrical center on said mounting cover prior to driving said connector away from said slide-arm.

16. The method of claim 15 wherein driving said connector away from said slide-arm includes engaging said electrical center with said connector.

* * * * *